United States Patent [19]

Fox et al.

[11] 4,160,442

[45] Jul. 10, 1979

[54] FIREPLACE COVER

[75] Inventors: Charles T. Fox, Signal Mountain; Edward P. Graham, Chattanooga, both of Tenn.

[73] Assignee: United States Stove Company, Chattanooga, Tenn.

[21] Appl. No.: 858,168

[22] Filed: Dec. 7, 1977

[51] Int. Cl.[2] ..... F24C 15/10

[52] U.S. Cl. ..... 126/140; 126/202; D7/208

[58] Field of Search ..... 126/140, 202; D7/206, D7/208; D23/94, 95, 96

[56] References Cited

U.S. PATENT DOCUMENTS

| | | | |
|---|---|---|---|
| D. 178,132 | 6/1956 | Love | D48/23 R |
| D. 206,473 | 12/1966 | Volz | D7/208 |
| 1,590,396 | 6/1926 | Sutton | 126/140 |
| 1,606,112 | 11/1926 | Sutton | 126/140 |
| 2,031,732 | 2/1936 | Plym | D23/96 |
| 4,010,730 | 3/1977 | Mitchell | 126/140 |
| 4,036,205 | 7/1977 | Hayes | 126/140 |

*Primary Examiner*—Ronald C. Capossela
*Attorney, Agent, or Firm*—Harrington A. Lackey

[57] ABSTRACT

A fireplace cover including a substantially rectangular flat sheet member of slightly greater width and height than the fireplace opening for overlapping and covering the same, a pair of one-piece foot members, each having a vertical leg mouned on the sheet member and fixed to a foot extending front-to-rear beneath and supporting the sheet member.

The fireplace cover is further characterized by a substantially U-shaped, anti-torsion, reinforcing member fixed to the rear surface of the sheet member extending substantially parallel to the top and side edges of the sheet member, but spaced uniformly from the corresponding edges to provide sufficient marginal areas to overlap the margins of fireplace openings of different sizes.

9 Claims, 5 Drawing Figures

FIREPLACE COVER

BACKGROUND OF THE INVENTION

This invention relates to a fireplace cover, and more particularly to a free-standing fireplace cover.

Fireplace covers made of solid sheet metal are known in the art, as disclosed in the following U.S. patents:

| | | |
|---|---|---|
| D-178,132 | Love | June 26, 1956 |
| D-206,473 | Volz | Dec. 13, 1966 |
| 1,590,396 | Sutton | June 29, 1926 |
| 1,606,112 | Sutton | Nov. 9, 1926 |
| 4,010,730 | Mitchell | Mar. 8, 1977 |

The Volz patent also discloses a flat fireplace cover member supported for free-standing by separate individual front and rear feet respectively attached to the front and rear surfaces of the fireplace cover.

The following patents disclose solid fireplace covers incorporating reinforcing members:

| | | |
|---|---|---|
| 624,984 | Scanlan | May 16, 1899 |
| 3,789,825 | Reiner | Feb. 5, 1974 |
| 3,888,232 | LeBrun | June 10, 1975 |

However, none of the above patents disclose a solid fireplace cover having a U-shaped, anti-torsion bar spaced inward to the top and side edges to provide marginal overlapping portions for the fireplace opening. Nor do any of the above patents disclose an anti-torsional bar having a circular tubular cross-section.

Furthermore, none of the above patents disclose a solid planar fireplace cover incorporating in combination anti-torsional reinforcing members and supporting feet to provide a stable free-standing fireplace cover.

SUMMARY OF THE INVENTION

It is therefore an object of this invention to provide a fireplace cover including a solid flat, or planar, cover sheet supported by underlying foot members, each foot member having a horizontal foot extending substantially forwardly and rearwardly of the plane of the sheet member.

It is another object of this invention to provide a solid planar sheet member for a fireplace cover incorporating a U-shaped anti-torsion member, preferably of circular tubular stock, fixed to the rear surface of the sheet member. The bight and arm portions of the U-shaped anti-torsion member are spaced inwardly from corresponding edges of the sheet member to provide substantial marginal areas to overlap fireplace openings of varying sizes.

The fireplace cover made in accordance with this invention preferably includes a flat or planar solid sheet, or plate, member, preferably of rectangular configuration and of a size slightly larger than the rectangular fireplace opening which the sheet member is adapted to cover. Foot members are fixed to the bottom marginal portion of the sheet member to support the sheet member for covering the fireplace opening, or to permit the cover to assume a free-standing position when removed from the fireplace opening.

Each foot member preferably includes an integral, single-piece, longitudinal strip of metal bent to form an upright or vertical leg and a horizontal foot connected by an angular strut member. The leg is mounted upon the rear surface of the sheet member. The strut member declines rearwardly from the leg and merges into the rear end of the foot which extends forward beneath and engaging the bottom margin of the sheet member. The foot extends substantially forward and rearward of the plane of the sheet member to provide stable support for the upright sheet member. The strut member provides not only a secure connection between the vertical leg and the horizontal foot, but also declines rearwardly to resist any rearward turning moment exerted upon the cover.

The bottom marginal edge portion of the sheet member is preferably turned to form a forwardly extending flange to abut flush on top of the foot for additional stability, as well as for reinforcement of the sheet member.

An inverted U-shaped, anti-torsional member is secured firmly against the rear surface of the sheet member so that the upper bight portion and the side arm portions of the U-shaped reinforcing member are spaced substantially parallel to, but substantially inwardly of, the corresponding top and side edges of the sheet member to resist twisting or torsional forces inherent in a thin plate member. The reinforcing member preferably has a circular tubular cross-section to provide maximum torsional rigidity for the flat sheet member, as contrasted with the shape of any other anti-torsional reinforcing member of the same material and weight.

Preferably the means for mounting the foot members to the sheet member include sleeve members formed on the rear surface of the sheet member, such as by struck-out straps adapted to telescopingly receive the legs of the foot members. A flexible detent, also preferably struck out from the steel strap material from which the legs are made, provides a latching dog adapted to be flexibly or elastically compressed as the leg moves upward through the sleeve members, but is adapted to expand into a locking position above one of the sleeve members when each foot member is fully assembled in its operational supporting position. Such detachable leg structure facilitates the disassembly of the foot members from the sheet members for shipping and storage and for assembly of the foot members upon the sheet member without tools.

DESCRIPTION OF THE PREFERRED EMBODIMENT

Figure 1:
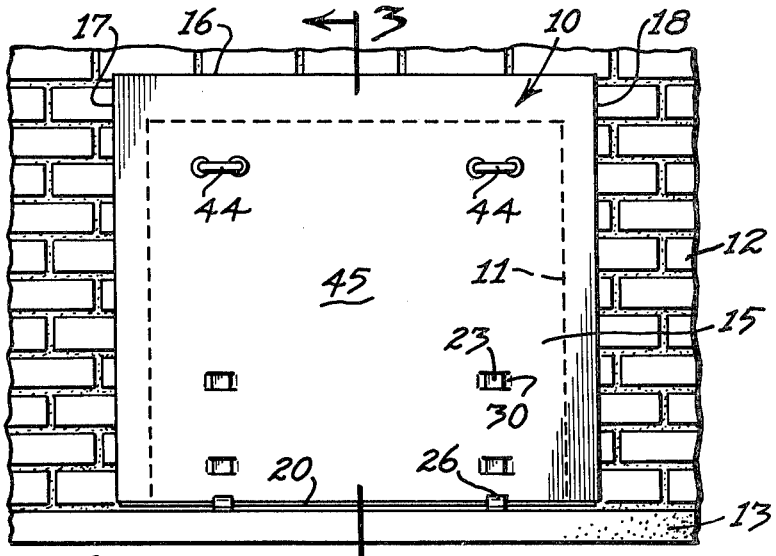
FIG. 1 is a front elevation of a fireplace cover made in accordance with this invention in operative position resting upon a hearth and closing a fireplace opening.
Figure 2:
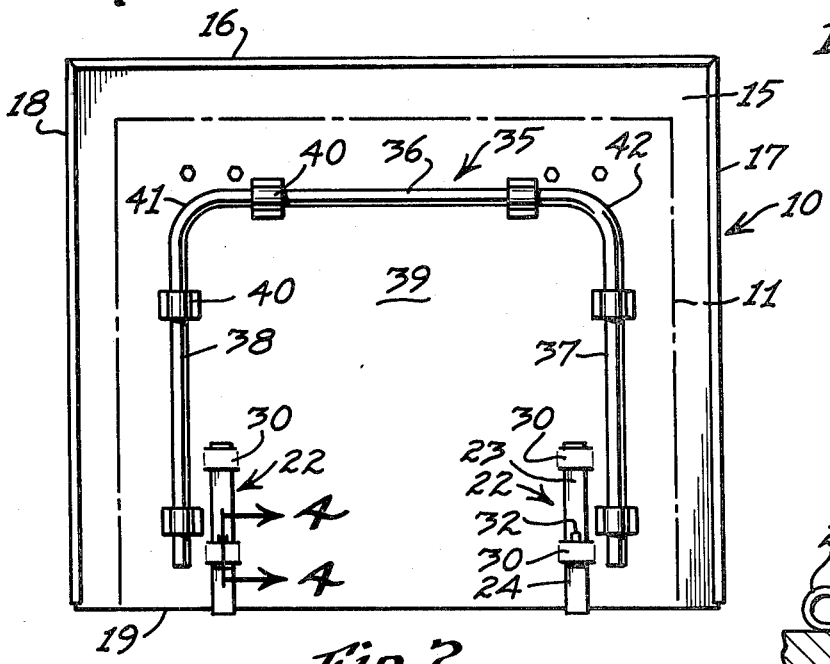
FIG. 2 is a rear elevation of the fireplace cover disclosed in FIG. 1, with the fireplace opening illustrated in phantom.
Figure 3:
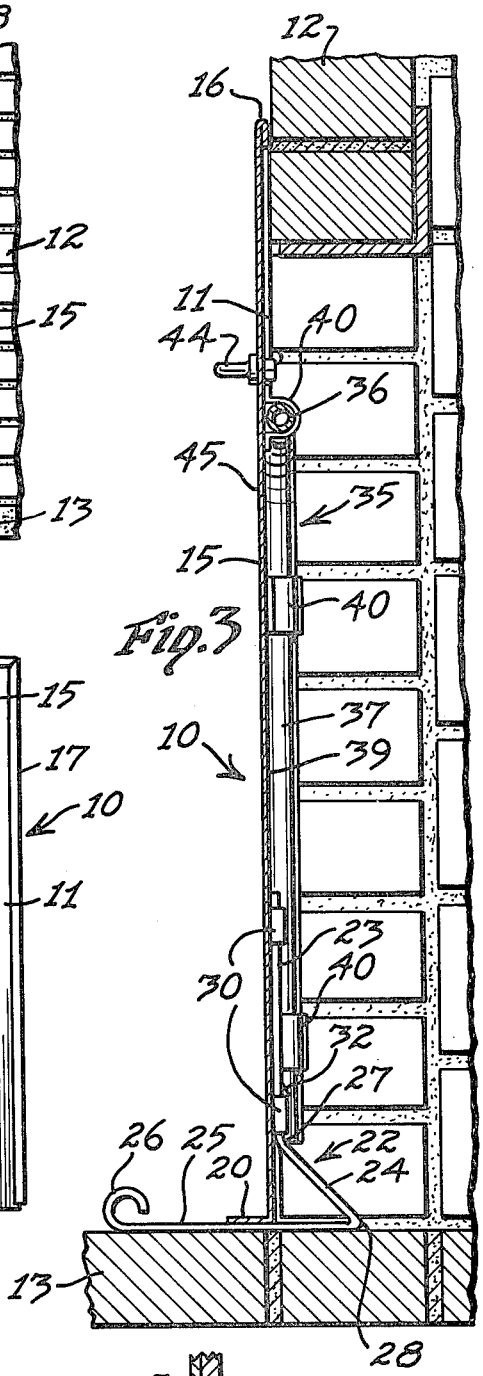
FIG. 3 is an enlarged section taken along the line 3—3 of FIG. 1.

Referring now to the drawings in more detail, FIGS. 1-3 disclose a fireplace cover 10 made in accordance with this invention adapted to cover a fireplace opening 11 in a fireplace 12 formed over a hearth 13.

The fireplace cover 10 includes a rectangular flat or planar sheet or plate member 15, preferably formed from sheet metal. The sheet member 15 preferably includes hemmed top edges 16 and side edges 17 and 18, and a bottom edge portion 19 turned to form a forwardly projecting foot flange 20. The foot flange 20 is preferably straight and substantially horizontal.

The sheet member 15 has a width and a height slightly greater than the corresponding dimensions of the largest fireplace opening 11 adapted to be covered by the cover 10, so that the top and side marginal portions of the sheet member 15 overlap the corresponding edges of the fireplace opening 11, as best disclosed in FIGS. 1 and 2.

The sheet member 15 is adapted to be supported in an upright, substantially vertical, position, for covering the fireplace 11, or for support in a free-standing position when not covering the fireplace opening 11, by one or more foot members 22. In a preferred form of the invention, a pair of foot members 22 are fixed to the sheet member 15 in symmetrical spaced relationship to support the sheet member 15 in a stable, upright position.

Each foot member 22 includes an upright, substantially vertical, leg 23, the bottom portion of which integrally merges into a rearward declining strut member 24, the lower end of which merges into the rear end of a forward projecting horizontal foot 25. The front end portion 26 of the foot 25 is free and curved to eliminate a front sharp edge as well as for ornamentation. In a preferred form of the invention, the foot member 22 is formed of a single piece of strap metal of uniform cross-section, bent at the joint 27 between the strut member 24 and the leg 23, and bent at the joint 28 between the strut member 24 and the foot 25.

The foot 25 is adapted to extend beneath and engage flush against the bottom surface of the foot flange 20. The rear end or joint 28 of the foot 25 is far enough behind the plane of the sheet member 15, and the front end portion 26 is far enough in front of the plane of the sheet member 15, to provide adequate stability for the sheet member 15 and resist tendencies for the sheet member 15 to turn over, forward or rearward.

Each leg 23 is long enough to extend through a pair of vertically spaced sleeve members 30, which are preferably formed by striking out rearward corresponding bands from the sheet member 15, as disclosed in the drawings. The sleeve members 30 are adapted to telescopingly receive the corresponding leg members 23. The legs 23 are also long enough to present a sufficient bearing surface against the sheet member 15 to minimize strain resulting from any turning forces or moments exerted upon the cover 10.

Figure 4:
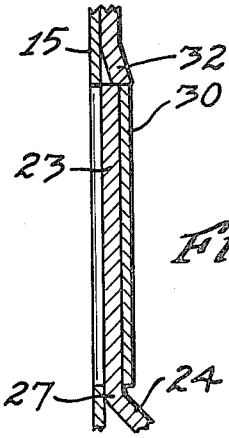
FIG. 4 is a greatly enlarged, fragmentary section taken along the line 4—4 of FIG. 2.

In order to secure each leg 23 in its respective sleeve members 30, a small detent 32 is struck out rearward of the leg 23 at an elevation permitting the detent 32 to project over and engage the top of the lower sleeve member 30, when the foot 25 engages the bottom surface of the flange 20 in operative position. The detent 32 is preferably, either by virtue of the nature of the material from which it is made, or by virtue of its dimensions or mass, sufficiently flexible or elastic to be compressed as the leg 23 is forced upward in telescoping relationship within its corresponding sleeve members 30. Thus, the compressed detent 32 will snap rearward into latching position when it clears the upper edge of the lower sleeve member 30, as best disclosed in FIG. 4.

In the preferred form of the invention, the strut member 24 preferably forms an angle of approximately 45° with the foot 25, so that the strut member 24 not only functions as a semi-rigid connection between the leg 23 and the foot 25, but also is of a sufficient angle and dimension to effectively resist any bending moment which might be exerted rearward upon the sheet member 15 about the rear edge 28 of the foot 25 as a fulcrum.

The foot flange 20 also functions to resist any forward turning moment which might be exerted upon the sheet member 15, and also functions as a reinforcing member for the thin sheet member 15.

In order to further reinforce, and make more rigid, the sheet member 15, an inverted U-shaped reinforcing member 35 having a substantially horizontal bight portion 36 and a pair of substantially vertical arm portions 37 and 38, is firmly secured to the rear surface 39 of the sheet member 15.

The reinforcing member 35 is preferably made of a onepiece or unitary elongated member bent at the arcuate portions 41 and 42 to form the respective bight and arm portions 36, 37 and 38. Moreover, the unitary reinforcing member 35 is preferably made of circular tubular material.

The reinforcing member 35 is firmly secured to the rear surface 39 by the arcuate clamps 40 welded to the rear surface 39 on opposite sides of the tubular bight and arm portions 36, 37 and 38.

The reinforcing member 35 is of such dimension and so located upon the rear surface 39 of the sheet member 15 that the bight portion 36 is substantially parallel to and spaced, not only below the top edge 16 of the sheet member 15, but also below the top edge of the fireplace opening 11. In a similar manner, the arm portions 37 and 38 are respectively spaced inward from, and substantially parallel to, the respective side edges 17 and 18 of the sheet member 15, and also spaced inward from the corresponding side edges of the fireplace opening 11. This spacing of the reinforcing member 35 within the fireplace opening 11 provides free marginal areas of the sheet member for flush overlapping of the corresponding edges of the fireplace opening 11 without any interference on any part of the rearward projecting reinforcing member 35 or tube clamps 40, as best disclosed in FIG. 3.

On the other hand, the bight portion 36 is spaced high enough upon the sheet member 15 to be in the upper portion of the sheet member, that is substantially above a horizontal median line through the sheet member 15, and the arm portions 37 and 38 are symmetrically spaced sufficiently far apart, at a distance substantially greater than half the width of the sheet member 15, to afford adequate reinforcement or resistance against twisting or torsional movement in the thin sheet member 15.

As best disclosed in FIG. 2, the foot members 22 are located within the perimeter of the reinforcing member 35, or in other words, between the arm portions 37 and 38. In this manner, the arm portions 37 and 38 may be spaced as far apart as possible in order to provide maximum anti-torsional resistance, yet still clear the fireplace opening 11 when the cover 10 is in operative position. The foot members 22 do not require as great a transverse spacing to provide their optimal functional support for the sheet member 15 as do the arm portions 37 and 38 to provide their maximal functional reinforcing support.

A pair of handles 44 of any desired configuration may be secured to the front surface 45 of the sheet member 15, as disclosed in FIGS. 1, 2 and 3, to facilitate handling and moving the fireplace cover 10.

Figure 5:
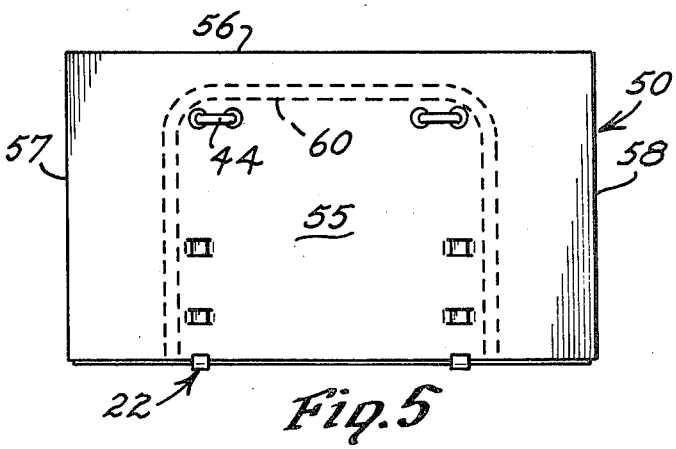
FIG. 5 is a front elevation of a modified form of the fireplace cover.

The fireplace cover 50 disclosed in FIG. 5 has substantially the same construction as the fireplace cover 10, with the exception of the variation in the relative dimensions of the top edge 56 and the side edges 57 and 58. The foot members 22 are identical. The reinforcing member 60 is identical in construction to the reinforcing member 35, except being of slightly different dimensions to provide overlapping side and top marginal portions of the sheet member 55 of different dimensions than the corresponding overlapping portions of the cover 10, in order to cover fireplace openings of correspondingly different relative dimensions.

The fireplace cover 10 is preferably stored and transported in disassembled position, with the foot members 22 removed from the corresponding sleeve members 30 of the sheet member 15. Thus, considerably less space is used during the handling of the fireplace cover 10 before it reaches the ultimate consumer and is placed in use to cover a fireplace 12.

The particular construction of the sleeve members 30 and the detent 32 permits the consumer to assemble the foot members 22 upon the sheet member 15 with relatively little difficulty and without the need of tools. Once the foot members 22 have been assembled and secured in their latched positions by virtue of the detents 32, the cover 10 may remain assembled to support the sheet member 15 in its operative position covering the fireplace opening 11 or in its inoperative free-standing position, not covering the fireplace 12.

The particular circular tubular reinforcing member 35 as shaped and located on the rear surface 39 of the sheet member 15 substantially rigidifies the sheet member 15, even when the sheet material is relatively thin, so that the cover is always stable in its operative covering position or its inoperative free-standing position.

The solid sheet member 15 with its overlapping edge portions securely closes the fireplace opening 11 to protect the room against falling logs or erupting sparks when the fire is unattended. Moreover, the solid sheet member 15, firmly engaging the marginal edge portions of the fireplace opening 11, minimizes the loss of warm air from the room up the chimney, as the fire is dying down with the damper open.

What is claimed is:

1. A cover for a fireplace having a front opening above a hearth, comprising:

(a) a flat sheet member of generally the same shape as, but of greater marginal extent in height and width than, the fireplace opening which said sheet member is adapted to cover, (b) said sheet member having a front surface and a rear surface, an upper marginal portion, a horizontal bottom marginal portion, and opposite side portions, (c) at least one foot member having a horizontal foot, (d) means attaching said foot member to said sheet member so that said foot extends substantially normal to the plane of said sheet member adjacent said bottom marginal portion and rests upon the hearth for the free-standing support of said sheet member to cover said fireplace opening in operative position, (e) a U-shaped reinforcing member having a bight portion and two arm portions, (f) means securing said U-shaped reinforcing member against the rear surface of said sheet member so that said bight portion is generally adjacent to, but spaced from, the upper marginal portion of said sheet member, and each of said arm portions is spaced generally adjacent to, but spaced from, the opposite side portions of said sheet member.

2. The invention according to claim 1 in which the bight portion and the arm portions of said U-shaped reinforcing member have circular tubular cross-sections.

3. The invention according to claim 1 in which said sheet member is substantially rectangular and has a top edge and opposite side edges, and the fireplace opening adapted to be covered is substantially rectangular, said bight portion lying substantially parallel to said top edge and spaced above said bottom marginal portion a distance less than the height of the fireplace opening, said arm portions being uniformly spaced from, and substantially parallel to, said side edges, and spaced apart a distance from each other less than the width of the fireplace opening.

4. The invention according to claim 3 comprising a pair of said foot members, each of said foot members having a vertical leg, said legs being spaced apart a distance less than the distance between the arm portions of said U-shaped reinforcing member, and means attaching each of said legs to the rear surface of said sheet member between said arm portions.

5. The invention according to claim 1 in which the bottom marginal portion of said sheet member comprises a bottom flange projecting forward of the plane of said sheet member and resting upon said foot.

6. The invention according to claim 1 in which said foot extends beneath and engages said horizontal bottom marginal portion.

7. The invention according to claim 6 in which said foot member comprises a leg and a strut member having an upper end fixed to said leg and a bottom end fixed to said foot at a position spaced substantially laterally of the plane of said sheet member.

8. The invention according to claim 6 in which said foot has opposite end portions lying on opposite sides of the plane of said sheet member.

9. The invention according to claim 7 further comprising a sleeve member attaching each of said legs to the rear surface of said sheet member and telescopingly receiving said leg for depressible slidable movement through said sleeve member and for expandable movement over the top of said sleeve member when said foot member is in operative position supporting said sheet member, for latching said foot member to said sheet member.

* * * * *